United States Patent [19]

Corain

[11] 4,406,308

[45] Sep. 27, 1983

[54] DEVICE FOR CHANGING THE REED BEATING POSITION IN LOOMS FOR TERRY FABRICS

[75] Inventor: Luciano Corain, Vicenza, Italy

[73] Assignee: Nuovo Pignone S.p.A., Florence, Italy

[21] Appl. No.: 202,713

[22] Filed: Oct. 31, 1980

[30] Foreign Application Priority Data

Nov. 26, 1979 [IT] Italy ..... 27544 A/79

[51] Int. Cl.[3] ..... D03D 39/22

[52] U.S. Cl. ..... 139/27

[58] Field of Search ..... 139/26, 27

[56] References Cited

U.S. PATENT DOCUMENTS

| | | | |
|---|---|---|---|
| 1,591,912 | 7/1926 | Brown | 139/27 |
| 3,315,705 | 4/1967 | Burgess | 139/26 |
| 3,939,876 | 2/1976 | Robert | 139/26 |
| 4,294,290 | 10/1981 | Freisler | 139/26 |

FOREIGN PATENT DOCUMENTS

| | | | |
|---|---|---|---|
| 745226 | 7/1970 | Belgium | 139/26 |
| 165 | of 1900 | United Kingdom | 139/27 |

*Primary Examiner*—Henry Jaudon

*Attorney, Agent, or Firm*—George P. Hoare, Jr.

[57] ABSTRACT

Device for changing the reed beating position in looms for terry fabrics, in which the feet of the followers rigid with the reed are respectively connected by connecting rods to corresponding cams keyed on a shaft rotatably supported by the machine sley in proximity to the rotational axle of said sley.

A gear is keyed on to said shaft and engages with a toothed sector supported by a member idly mounted on said rotational axle of the sley and is hinged to the lower end thereof by two arms hinged together, their common joint being inserted and guided in an aperture in the form of a circular arc formed in a vertical rocker arm hinged to a fixed part of the loom at the lower end of its aperture, and kept resting on a fixed shoulder of the loom by a spring, in which position said aperture constitutes an arc of a circle having its center on said rotational axle of the sley.

Finally, the ends of two bars are hinged at two different points to the shank of said vertical rocker arm, the other ends of the bars being inserted into corresponding vertical parallel slots in a control lever operated by a control cam, where they rest on supports supported by said control lever at the lower ends of said vertical slots, said bars being individually connectable to said control lever by connecting pins which can be inserted into an axial slot in said other ends of the bars by the action of two electromagnetic controls supported on the opposing faces of said control lever.

3 Claims, 3 Drawing Figures

DEVICE FOR CHANGING THE REED BEATING POSITION IN LOOMS FOR TERRY FABRICS

This invention relates to a device, in a loom for terry fabrics, for accurately and reliably changing the reed beating position and the height of the terry, while the loom is moving.

More specifically, the present invention relates to an improvement to the device already described in our previous U.S. Pat. No. 4,099,546 dated July 11, 1978.

To form the terry characteristic of terry fabrics, the reed which rotates rigidly with the loom sley must be moved from its normal or "closed" position, in which it beats the inserted weft yarn against the edge of the already formed fabric, to a new position more withdrawn from said edge, or "open" position, in which it moves the inserted weft yarns only into the vicinity of said edge but without beating them thereagainst. Summarising, the reed must be able to be moved into two different beating positions relative to the edge of the already formed fabric, in which the inserted weft yarns are respectively withdrawn or beaten against the fabric edge. On the other hand, in order to vary the height of the terry, this being necessary for special weaving effects, said "open" position of the reed must be able to be varied.

A device for changing the reed beating position in order to make it carry out the actual beating after a number of weft insertions so as to create the characteristic terry, and for varying the height of the terry is already known from the above patent.

Said known device is constituted substantially by a set of followers which are rigid with the reed hinge-mounted to the loom sley and are kept by return springs constantly in contact with a like set of fork profiles hinged to appropriate brackets on the fixed breastplate of the loom.

The position of said fork profiles can be adjusted, in order to vary the reed beating position, by means of a corresponding set of cams cooperating with the forks of said fork profiles, which are keyed on to a common shaft rotatably supported by the fixed breastplate of the loom and rotated by a control cam by way of a control lever kept by a spring in resilient contact with the profile of said cam, to which the end of a bar is hinged, its other end being hingable, in order to vary the height of the terry, to various points on the shank of a toothed rocker arm hinged to a fixed part of the loom and engaging with a gear rigid with said shaft.

Although such a known device has the advantage that its mass does not influence the inertia of the sley, given the fact that only said set of followers moves with this latter, and thus allows a high loom operating speed, it comprises a series of drawbacks, the main one of which derives substantially from the use of fork profiles as shoulder elements for changing the reed beating position. This is because by virtue of the reciprocating motion of the sley and consequently of the reed, a mutual sliding motion occurs between the set of fork profiles and the corresponding set of followers, and this requires adequate lubrication.

Besides being difficult because it has to be carried out in positions of difficult access by virtue of the fact that the fork profiles are mounted on the loom breastplate precisely below the terry fabric which is gradually being formed, this lubrication is prejudicial to the fabric in that any splashes of lubricant can soil and thus deteriorate the overlying fabric under formation. Moreover, the operation involved in bringing all the fork profiles into perfect alignment or phase is extremely complicated and long.

On the other hand, if the fork profiles should become misaligned during the operation of the loom, this could not be corrected rapidly because the overlying formed fabric prevents access to said fork profiles.

A further drawback of the known device is the fact that the cam shaft and the relative fork profiles are mounted on the fixed breastplate of the loom on which the roller which drives the formed fabric is also mounted, because of which the variations in the warp tension, i.e. the tension under which the formed fabric is driven and wound on to the fabric collection beam, acts on said members which determine the reed position, so influencing said reed position with the result that defective fabric can be produced, i.e. fabric in which so-called "streaks" are present.

A further drawback is due to the return springs which maintain contact between the followers and the fork profiles. In this respect, because of the reciprocating motion of the sley and consequently of the reed, said springs are continuously under fatigue stress because of which they are easily subject to yielding and/or fracture, on which it is necessary to halt the loom for their replacement, with consequent loss of productivity.

Finally, a further drawback of the known device is the fact that in order to vary the terry height, the point at which said bar is hinged to the shank of said toothed rocker arm must be varied, for which it is necessary to halt the loom. The object of the present invention is to obviate the aforesaid drawbacks by providing a device for changing the reed beating position which uses neither return springs nor members subject to mutual sliding and thus requiring lubrication prejudicial for the fabric, and which further does not require complicated alignment operations and which is insensitive to variations in the warp tension, and finally which enables the height of the terry to be varied without having to halt the loom.

This object is substantially attained by dispensing with the aforesaid fork profiles, and more specifically by the fact that the feet of the followers rigid with the reed hinged to the loom sley are connected rods to corresponding respective cams keyed on to a common shaft rotatably supported by the loom sley in proximity to the rotational axle thereof. This is because such a connection involving a connecting rod not only enables the return springs to be dispensed with, presents no mutual sliding and is insensitive to variations in the warp tension, but also allows easy and rapid alignment by virtue of the fact that the cams are mounted on the sley itself and are situated in positions which are always easily accessible. Furthermore, as the cam shaft is mounted in a position very close to the rotational axle of the sley, it influences the inertia of said sley only to a negligible extent.

On the other hand, as the cam shaft, the rotation of which determines the movement of the reed, is mounted on the sley and moves therewith, it is apparent that the gear rigid with said cam shaft cannot be engaged with the toothed sector of a toothed rocker arm hinged to a fixed part of the loom as in the known device, but instead must be engaged with a toothed sector coupled to a rocker arm hinged to a fixed part of the loom by a system arranged not only to enable said toothed sector to rotate in synchronism with the loom sley, but also to ensure that the reed is always compulsorily in the "closed" position when the sley is completely open, this being necessary in looms, as is known, in order for the reed not to interfere with the heddle frames and so damaging the terries.

This is substantially attained by the fact that said toothed sector is coupled to said rocker arm of a mechanical toggle system. More specifically, the toothed sector engaged with the gear of the cam shaft is supported by a member idly mounted on the rotational axle of the sley and hinged to the lower end of said sley by two arms hinged together, the common joint of which is inserted and guided in an aperture in the form of a circular arc in a vertical rocker arm, which is hinged to a fixed part of the loom at the lower end of said aperture and is kept resting on a fixed shoulder of the loom by means of a spring. Furthermore, said circular arc aperture in the vertical rocker arm is formed such that it constitutes an arc of a circle having its centre on the rotational axle of the sley when said vertical rocker arm rests on said shoulder, in which state the reed is in the "closed" position.

In this manner, said toothed sector can be rotated by the sley, and as said joint moves along an arc of a circle having its centre on the rotational axle of the sley, no relative rotation is produced between the toothed sector and the cam shaft because of which the reed is always kept in the "closed" position during the entire stroke of the sley. On the other hand, when the reed is in the "open" position, and thus, as will be explained in detail hereinafter, the aperture in the rocker arm is rotated about its lower end towards the rotational axle of the sley, the opening movement of the sley compels said joint to follow the shape of the aperture and thus move from a closer to a further position from said rotational axle of the sley, to compel the reed to pass from its "open" position to its "closed" position when the sley is completely open, to then return to its "open" position when the sley closes again.

In short, in the device according to the invention for changing the reed beating position from a "closed" position to an "open" position and vice versa in a loom for terry fabric, said device comprising a reed hinged to the loom sley and provided with followers cooperating with corresponding cams on a cam shaft engaged, by means of a gear rigid therewith, with a toothed sector rotated by a vertical rocker arm hinged to a fixed part of the loom and operated in its turn by a control cam by way of a control lever which, maintained by a spring resiliently in contact with the profile of said control cam, acts on the shank of said vertical rocker arm by means of a bar, the feet of the followers rigid with the reed are respectively connected by connecting rods to corresponding cams keyed on to said cam shaft, which is rotatably supported by said loom sley in proximity to the rotational axle of said sley, and said toothed sector is supported by a member mounted idly on said rotational axle of the sley and hinged to the lower end of said sley by two arms hinged together, the common joint of which is inserted and guided in an aperture in the form of a circular arc provided in said vertical rocker arm, which is hinged to a fixed part of the loom at the lower end of said aperture and is kept resting by a spring on a fixed shoulder of the loom, in which condition the reed is in its said "closed" position, means also being provided for varying said "open" position of the reed, and thus the height of the terry, without having to halt the loom.

According to a further characteristic of the present invention, said aperture in the form of a circular arc provided in said vertical rocker arm constitutes an arc of a circle having its centre on said rotational axle of the sley when said vertical rocker arm is resting on said fixed shoulder of the loom, i.e. with the reed in its "closed" position.

Finally, according to a further characteristic of the present invention, said means for varying said "open" position of the reed, i.e. the height of the terry, without having to halt the loom consist of two bars hinged at one of their ends to two different points on said shank of said vertical rocker arm, their other ends being inserted into corresponding vertical parallel slots in said control lever, where they rest on supports supported by said control lever at the lower ends of said vertical slots, said bars being individually connectable to said control lever by means of two electromagnetic controls which are supported on the opposing faces of said control lever and can insert a connection pin into a respective axial slot present at said end of said bars. In this manner, in order to vary the height of the terry, it is necessary only to operate said electromagnetic controls so as to connect to said control lever one or the other of the two bars, and this can be done with the loom in movement. In this respect, as the two bars are hinged at different points on the shank of the vertical rocker arm, they cause said vertical rocker arm and consequently the toothed sector, the cam shaft and thus the reed followers to rotate under the action of the control lever to an extent which is different in each case, with the consequence that the reed is withdrawn into positions which differ relative to the edge of the fabric under formation, this leading to a variation in the height of the terry, as is known.

The invention will be more apparent with reference to the accompanying drawings, which illustrate a preferred embodiment thereof given by way of non-limiting example in that technical or constructional modifications can be made thereto without leaving the scope of the present invention, and in which.

Figure 1:
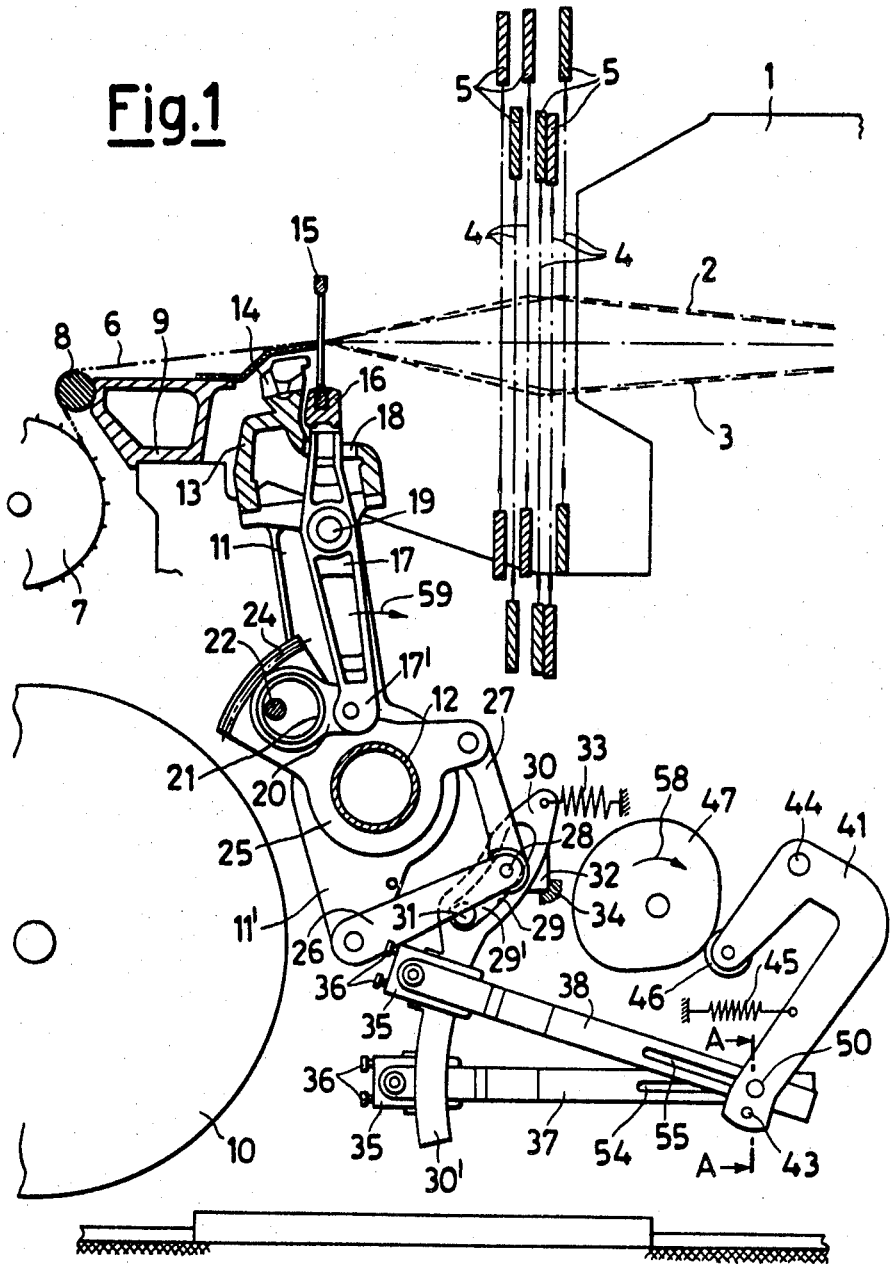
FIG. 1 is a diagrammatic partial side sectional view of a loom on which the device for changing the reed beating position according to the invention is mounted with the reed in the normal or "closed" position.

In FIG. 1, the reference numeral 1 indicates the fixed framework of the loom or rather a sidepiece of said loom, and 2 and 3 indicate the warp yarns which are guided by the heedles 4 of the loom frames 5 so that they cross with weft yarns, not shown on the figure, to form the fabric 6 which is dragged by the piece pulling roller 7 sliding on the drive roller 8 rotatably supported by the loom breastplate 9, and is wound on the fabric collection beam 10. The reference numeral 11 indicates a sley which is lowerly hinged to the machine sidepieces by means of the rotational axle 12, and supports on its head bar 13 the guide 14 for the weft needles. The loom reed 15 is rigidly mounted on the top of a part support 16, to which the followers 17 are fixed (in FIG. 1 only one follower is visible), and are inserted into suitable slots 18 in said head bar 13 of the sley 11, and hinged to said head bar 13 by hinging pins 19. Each foot or lower end 17' of said followers 17 is hinged to the end of a connecting rod 20, the other end of which is idly mounted on a corresponding cam 21, the cams 21 (only one of which is visible in FIG. 1) being all keyed on to a common shaft 22 which is rotatably supported by said sley 11 in proximity to its rotational axle 12, by means not shown in the figure. A gear 23 is keyed on to said cam shaft 22, and engages with a toothed sector 24 supported by a member 25 idly mounted on said rotational axle 12 of the sley 11.

The member 25 is also indirectly hinged to the lower end 11' of the sley 11 by means of arm 27 which is pivotally secured at one end by pivot pin 27' to the member 25. The arm 27, in turn, is secured at its opposite end to one end of arm 26 by pivot pin 28, the opposite end of the arm 26 being pivotally mounted to the lower end 11' of the sley 11 by pivot pin 26'. The pivot pin 28 is positioned in and guided in a circular arc aperture 29 provided in a vertical fork rocker arm 30. Said rocker arm 30 is hinged to the fixed framework of the loom by the pin 31 at the lower end 29' of its circular arc aperture 29, so that the distance of said end 29' from the rotational axle 12 of the sley never varies, whatever the rotation impressed on the rocker arm.

In addition, the rocker arm 30 is provided with a projection 32 which is kept resting by a spring 33 on a fixed shoulder 34 of the loom framework, to which position of the rocker arm the normal or "closed" position of the reed 15, as shown by the full line in FIG. 1, is made to correspond by suitably aligning the cams.

Figure 2:
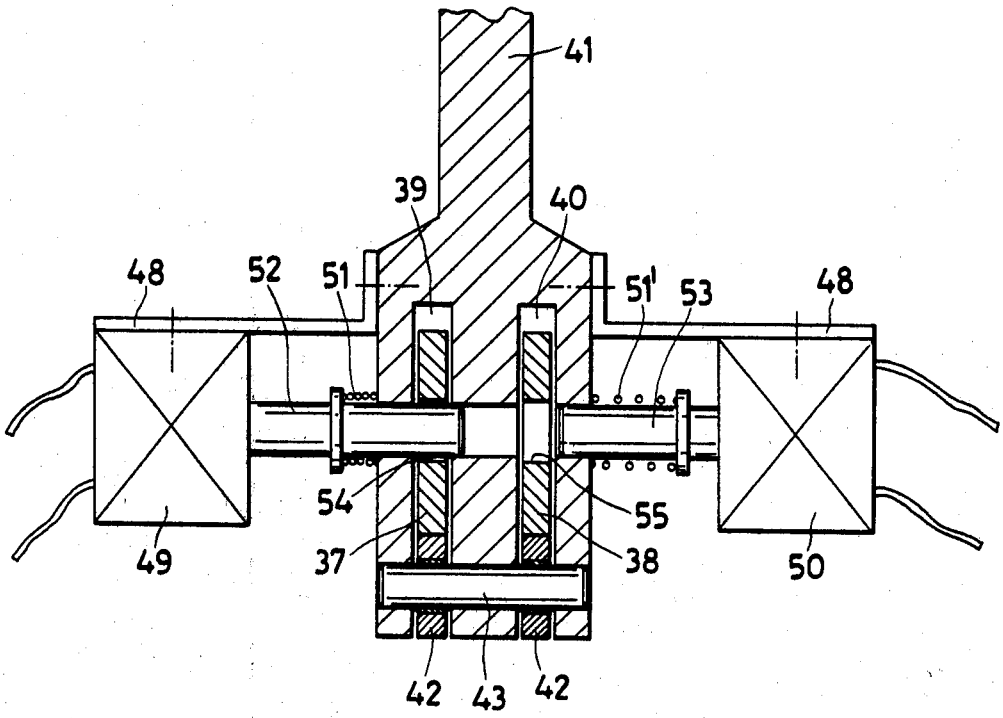
FIG. 2 is an enlarged front sectional view of a detail of the device of the invention, on the line A—A of FIG. 1.

The circular arc aperture 29 is formed such that it constitutes an arc of a circle which has its centre on the rotational axle 12 when the rocker arm 30 is resting on said shoulder 34. The ends of two bars 37 and 38 are hinged, by way of blocks 35 and fixing screws 36, to two different respective points on the two shanks 30' of said vertical fork 30 (in FIG. 1 only one shank is visible, the other lying below this), the other ends of said bars being inserted into corresponding vertical parallel slots, 39 and 40 respectively (see FIG. 2), provided in a control lever 41, where said bars rest on support rollers 42 idly mounted on a pin 43 supported by said control lever 41 at the lower ends of its slots 39 and 40. Said control lever 41, which is hinged at 44 to the fixed framework of the loom, has its slide roller 46 held resiliently by a spring 45 in contact with the profile of a control cam 47 hinged to the fixed framework of the loom and driven by means not shown in the figure, said control lever supporting on its two opposing faces, by means of brackets 48, two electromagnetic controls 49 and 50 arranged to insert their coupling pin 52 and 53 into the axial slots 54 and 55 respectively, provided in said bars 37 and 38, against the action of a return spring 51 and 51'.

The method of operation of such a device is immediately apparent.

If it is required to weave a normal fabric without terries, and thus operate with the reed always under complete beating, i.e. in the "closed" position, the two electromagnetic controls 49 and 50 need only be kept de-energised so that their coupling pins 52 and 53 are kept withdrawn by the springs 51 and 51' from the axial slots 54 and 55 in the bars 37 and 38.

In this manner, the control lever 41, by virtue of the clockwise rotation of the control cam 47 in the direction of the arrow 58, reciprocates idly without operating either of said bars 37 and 38, and consequently the vertical rocker arm 30 has its projection 32 kept resting by the spring 33 against the shoulder 34, i.e. in the configuration to which the "closed" position of the reed corresponds, as already stated. Rotation of the sley 11 about its axle 12 from the closed position shown in FIG. 1 to the open position in the direction of the arrow 59 causes the pivot pin 28 to move along the aperture 29, but as this constitutes an arc of a circle having its centre on the rotational axle 12 with the result that the pivot pin 28 travels through a trajectory the distance of which remains constant from the rotational axle 12, it is apparent that no relative rotation takes place between the toothed sector 24 and cam shaft 22, because of which the reed 15 always remains in the "closed" position for the entire stroke of the sley.

Figure 3:
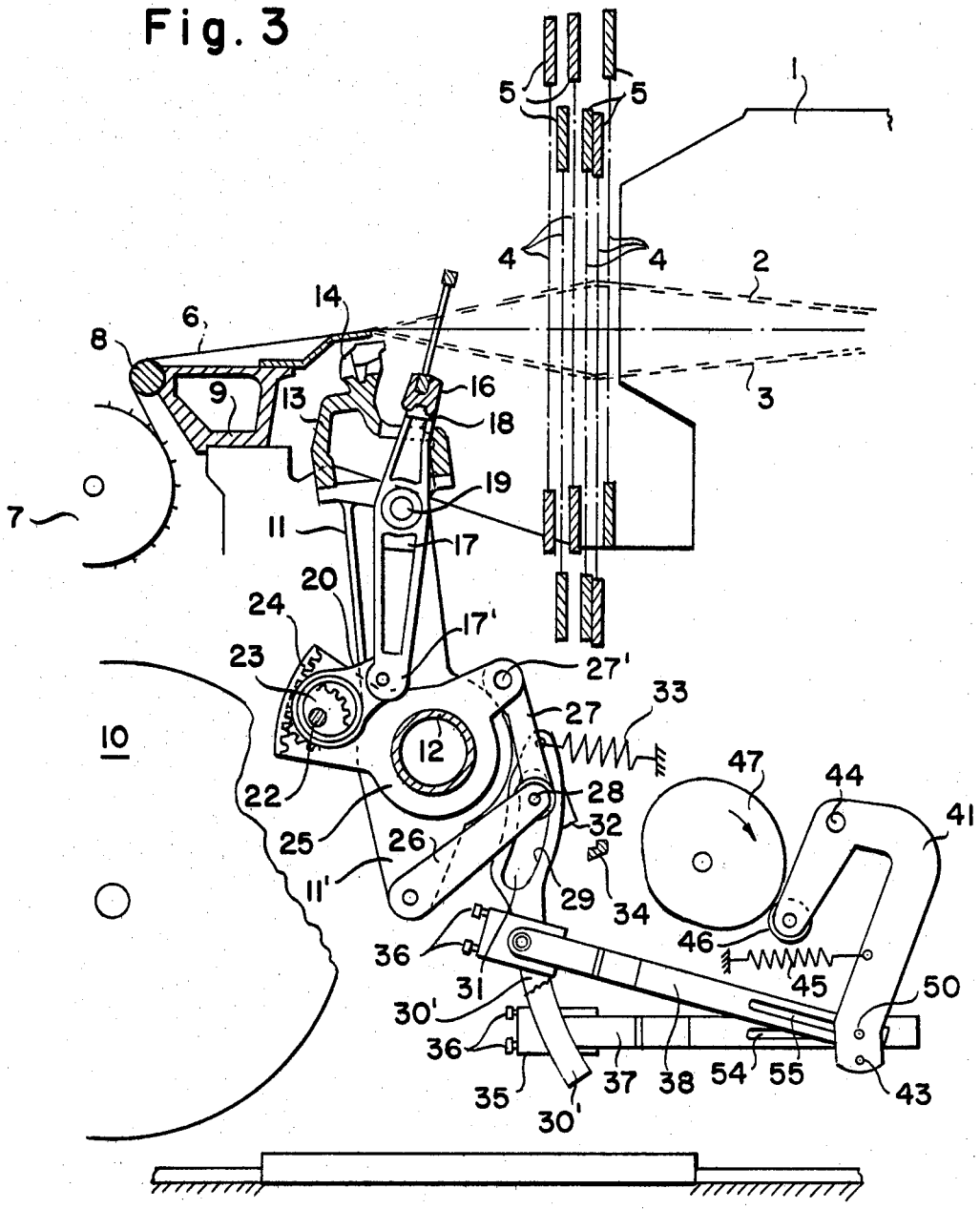
FIG. 3 is a diagramatic partial side sectional view of a loom on which the device for changing the reed beating position according to the invention is shown with the reed in the withdrawn or "open" position.

When it is required to weave terry fabric, the electromagnetic control 49 must be energised so as to couple the control lever 41 to the bar 37. In this manner, the rotation of the control cam 47 in the direction of the arrow 58 causes the control lever 41 to rotate in an anti-clockwise direction, with a consequent movement of the bar 37 coupled thereto towards the right, while the other bar 38 remains idle. As a result of this, the vertical rocker arm 30 is rotated anti-clockwise about its pin 31, with the result that its aperture 29 becomes positioned as illustrated by reference numeral 29''' as shown in FIG. 3 with its upper end 29'' displaced towards the rotational axle 12 of the sley. This displacement of the aperture 29 causes the arms 26 and 27 to move wider apart, thus determining an anti-clockwise rotation of the toothed sector 24 and consequently of the cam shaft 22. The anti-clockwise rotation of the cams 21 determines a lefthanded movement of the connecting rods 20 and consequently of the feet 17' of the followers 17, so that the reed becomes rotated clockwise about its hinging pins 19, and withdraws into its "open" position shown by dashed lines with the reference number 15' in FIG. 1.

Furthermore, during the opening stroke of the sley in the direction of the arrow 59, the pivot pin 28 is compelled to move downwards along the aperture 29'' and thus passes through a trajectory the distance of which increases from the rotational axis 12 in the direction from the upper end 29'' to the lower end 29' of the aperture.

As a result of this, the toothed sector 24 and consequently the cam shaft 22 undergo clockwise rotation, the connecting rods 20 move towards the right, and the reed 15' thus makes a clockwise rotation which moves it into its "closed" position when the sley 17 is at the end of its opening reciprocating movement, i.e when the joint 28 reaches the lower end 29' of the aperture, which in effect must always happen in order to prevent the reed from interfering with the frames 5 and thus damaging the heddles 4. The reed then returns to its "open" position 15' during the closure stroke of the sley, because the pivot pin 28 is compelled to move in the reverse direction along the aperture 29''.

Finally, in order to vary the height of the terry, this being required for particular weaving effects, it is necessary only to de-energise the electromagnetic control 49 in order to make the bar 37 idle, and energise the other electromagnetic control 50 in order to couple the other bar 38 to the control lever 41, and this can be done with the machine in movement. In this respect, as the bar 38 is coupled to the vertical rocker arm 30 at a point closer to the rotational pivot 31 of this letter, it transmits to said rocker arm an anticlockwise rotation of a greater extent than that transmitted by the other bar 37, and this greater rotation of the rocker arm leads to a greater clockwise rotation of the reed in a manner analogous to that previously described, with the result that the reed is withdrawn to a greater extent into a new "open" position shown by dashed lines and indicated by the reference numeral 15" in FIG. 1.

We claim:

1. A device for changing the reed beating position from a "closed" position to an "open" position and vice versa in a loom for terry fabric, comprising a reed hinged to the loom sley and provided with followers cooperating with corresponding cams on a cam shaft engaged, by means of a gear rigid therewith, with a toothed sector rotated by a vertical rocker arm hinged to a fixed part of the loom and operated in its turn by a control cam by way of a control lever which, maintained by a spring resiliently in contact with the profile of said control cam, acts on the shank of said vertical rocker arm by means of a bar, wherein the feet of the followers rigid with the reed are respectively connected by connecting rods to corresponding cams keyed on to said cam shaft, which is rotatably supported by said loom sley in proximity to the rotational axle of said sley, and said toothed sector is supported by a member mounted idly on said rotational axle of the sley and hinged to the lower end of said sley by two arms hinged together, the common joint of which is inserted and guided in an aperture in the form of a circular arc provided in said vertical rocker arm, which is hinged to a fixed part of the loom at the lower end of said aperture and is kept resting by a spring on a fixed shoulder of the loom, in which condition the reed is in its said "closed" position, means also being provided for varying said "open" position of the reed, and thus the height of the terry, without having to halt the loom.

2. A device as claimed in claim 1, wherein said aperture in the form of a circular arc provided in said vertical rocker arm constitutes an arc of a circle having its centre on said rotational axle of the sley when said vertical rocker arm is resting on said fixed shoulder of the machine, i.e. with the reed in its "closed" position.

3. A device as claimed in claim 1, wherein said means for varying said "open" position of the reed, i.e. the height of the terry, without having to halt the loom consist of two bars hinged at one of their ends to two different points on said shank of said vertical rocker arm, their other ends being inserted into corresponding vertical parallel slots in said control lever, where they rest on supports supported by said control lever at the lower ends of said vertical slots, said bars being individually connectable to said control lever by means of the two electromagnetic controls which are supported on the opposing faces of said control lever and can insert a connection pin into a respective axial slot present at said other end of said bore.

* * * * *